US010453628B2

(12) United States Patent
Guo et al.

(10) Patent No.: US 10,453,628 B2
(45) Date of Patent: Oct. 22, 2019

(54) OPPOSITE ARC ISOLATION DEVICE OF HIGH VOLTAGE DIRECT CURRENT RELAY

(71) Applicant: ZHEJIANG INNUOVO NEW ENERGY TECHNOLOGY CO., LTD., Dongyang, Zhejiang Province (CN)

(72) Inventors: Xiaobin Guo, Dongyang (CN); Haiyan Huang, Dongyang (CN); Dejin Du, Dongyang (CN); Yuanfeng Li, Dongyang (CN)

(73) Assignee: ZHEJIANG INNUOVO NEW ENERGY TECHNOLOGY CO., LTD., Dongyang (CN)

( * ) Notice: Subject to any disclaimer, the term of this patent is extended or adjusted under 35 U.S.C. 154(b) by 0 days.

(21) Appl. No.: 15/780,178

(22) PCT Filed: Jul. 7, 2016

(86) PCT No.: PCT/CN2016/089171

§ 371 (c)(1),
(2) Date: May 30, 2018

(87) PCT Pub. No.: WO2017/185525

PCT Pub. Date: Nov. 2, 2017

(65) Prior Publication Data

US 2018/0358188 A1 Dec. 13, 2018

(30) Foreign Application Priority Data

Apr. 29, 2016 (CN) ..... 2016 1 0276454

(51) Int. Cl.

| | |
|---|---|
| ***H01H 9/32*** | (2006.01) |
| ***H01H 33/06*** | (2006.01) |
| ***H01H 73/18*** | (2006.01) |

(52) U.S. Cl.
CPC ..... *H01H 9/32* (2013.01); *H01H 33/06* (2013.01); *H01H 73/18* (2013.01)

(58) Field of Classification Search
CPC ..... H01H 9/32; H01H 33/06; H01H 73/18; H01H 50/18; H01H 50/58; H01H 50/026;
(Continued)

(56) References Cited

U.S. PATENT DOCUMENTS 5,233,321 A * 8/1993 Blanchard ..... H01H 89/08 335/131
5,635,886 A * 6/1997 Pichard ..... H01H 73/045 335/132
(Continued)

FOREIGN PATENT DOCUMENTS

CN 2012820083 Y 7/2009
CN 101677044 A 3/2010
(Continued)

OTHER PUBLICATIONS

Translation of CN201868346 (Original document published Jun. 21, 2011) (Year: 2011).*

*Primary Examiner* — Truc T Nguyen
*Assistant Examiner* — William A Bolton
(74) *Attorney, Agent, or Firm* — Jiwen Chen

(57) ABSTRACT

The present invention discloses an opposite arc isolation device of a high voltage direct current relay, including a movable contact assembly and a fixed contact assembly, wherein the movable contact assembly includes a movable spring plate and a left movable contact and a right movable contact fixed at left and right ends of the movable spring plate; the fixed contact assembly includes a left fixed contact corresponding to the left movable contact and a right fixed contact corresponding to the right movable contact; an arc isolation member made of insulating material is provided between the left movable contact and the right fixed contact;
(Continued)

the front-to-rear dimension L of the arc isolation member is greater than the front-to-rear width M of a joint surface of the movable contacts with the fixed contacts; and, the arc isolation member has a height H that enables the isolation of opposite arcs between the two sets of movable and fixed contacts.

6 Claims, 7 Drawing Sheets

(58) Field of Classification Search
CPC ..... H01H 51/06; H01H 71/0214; H01H 2071/0292
USPC ..... 218/117, 155, 134, 139; 335/201, 202
See application file for complete search history.

(56) References Cited

U.S. PATENT DOCUMENTS 6,194,984 B1 * 2/2001 Kappel ..... H01H 50/546 218/152
8,354,906 B2 * 1/2013 Nagura ..... H01H 9/443 335/128
8,674,796 B2 * 3/2014 Ito ..... H01H 1/20 335/126
8,822,862 B2 * 9/2014 Cyuzawa ..... H01H 1/66 200/405
8,901,445 B2 * 12/2014 Tachikawa ..... H01H 9/40 218/26
9,076,620 B2 * 7/2015 Lee ..... H01H 50/305
2010/0207713 A1 * 8/2010 Sugisawa ..... H01H 50/54 335/192

FOREIGN PATENT DOCUMENTS

CN 201868346 U 6/2011
CN 205542492 U 8/2016
CN 205542493 U 8/2016
CN 205542494 U 8/2016
CN 205723228 U 11/2016
WO WO2016002116 A1 1/2016

* cited by examiner

OPPOSITE ARC ISOLATION DEVICE OF HIGH VOLTAGE DIRECT CURRENT RELAY

This is a U.S. national stage application of PCT Application No. PCT/CN2016/089171 under 35 U.S.C. 371, filed Jul. 7, 2016 in Chinese, claiming priority of Chinese Application No. 201610276454.0, filed Apr. 29, 2016, all of which are hereby incorporated by reference.

TECHNICAL FIELD OF THE INVENTION

The present invention relates to a high voltage direct current relay, and in particular to an opposite arc isolation device of a high voltage direct current relay.

BACKGROUND OF THE INVENTION

High voltage direct current relays are mostly mounted on buses and new energy vehicles. During the operation, the high voltage direct current relays will generate outwardly side-blown arcs. However, in the case where the cathode and anode of a high voltage direct current relay are connected inversely or vehicles such as buses brake suddenly, each set of movable and fixed contacts of the high voltage direct current relay will blow arcs inward, and opposite arcs will be generated between two sets of movable and fixed contacts. Once the opposite arcs come into contact with each other, the high voltage direct current relay is likely to be short-circuited, thereby resulting in fire, explosion or other accidents.

SUMMARY OF THE INVENTION

An object of the present invention is to provide an opposite arc isolation device of a high voltage direct current relay.

For this purpose, the present invention employs the following technical solutions. An opposite arc isolation device of a high voltage direct current relay is provided, comprising a movable contact assembly and a fixed contact assembly, wherein the movable contact assembly comprises a movable spring plate and a left movable contact and a right movable contact fixed at left and right ends of the movable spring plate; the fixed contact assembly comprises a left fixed contact corresponding to the left movable contact and a right fixed contact corresponding to the right movable contact; an arc isolation member made of insulating material is provided between the left movable contact and the right fixed contact; the front-to-rear dimension L of the arc isolation member is greater than the front-to-rear width M of a joint surface of the movable contacts with the fixed contacts; and, the arc isolation member has a height H that enables the isolation of opposite arcs between the two sets of movable and fixed contacts.

After the two sets of movable and fixed contacts come into contact with each other, opposite arcs will be generated sometimes. In the present invention, by physically isolating two strands of arcs, the occurrence of safety accidents caused by the contact of the two strands of opposite arcs is avoided. The arc isolation member may be made of ceramics, insulating plastics or other insulating materials.

Preferably, the arc isolation member is fixed on the movable spring plate; positioning notches are formed on a front side and a rear side of the movable spring plate; an accommodating groove running downward through the arc isolation member is formed at a lower end of the arc isolation member, and the accommodating groove transversely runs through the arc isolation member; a buckle structure is formed on the arc isolation member; and, the buckle structure is fitted with the positioning notches to position the movable spring plate within the accommodating groove. For ease of assembly, the arc isolation member is fixed to the movable spring plate through the buckle structure.

Preferably, the arc isolation members are formed by extending downward an insulating plate or an insulating cavity; a groove is formed between the left movable contact and the right movable contact of the movable spring plate, and the groove runs through the movable spring plate in a front-rear direction; and, when the movable spring plate moves up to allow the left movable contact to come into contact with the left fixed contact and the right movable contact to come into contact with the right fixed contact, the lower end of the arc isolation member are located within the groove. The arc isolation member and the insulating plate or the insulating cavity are formed integrally, and the material of the arc isolation member is consistent with the material of the insulating plate or the insulating cavity.

Preferably, the arc isolation member is of a hood-shaped structure; the arc isolation member comprises an arc isolation portion on an upper side and a buckle portion on a lower side; an accommodating chamber is formed within the buckle portion, and the buckle portion has an n-shaped section; the accommodating chamber runs through the buckle portion in an up-down direction, and the accommodating chamber transversely runs through the buckle portion, so that a front fixed portion on the front side of the movable spring plate and a rear fixed portion on the rear side of the movable spring plate are formed on the buckle portion; bosses are formed on lower edges on the inner side of the front fixed portion and the inner side of the rear fixed portion; the positioning notched longitudinally runs through the movable spring plate, and the arc isolation member is fixed to the movable spring plate so that upper edges of the bosses come into contact with a lower edge of the movable spring plate and a lower edge of the arc isolation portion comes into contact with an upper edge of the movable spring plate.

Preferably, a through hole for allowing a push rod to pass therethrough is formed on the movable spring plate; the top of the push rod is located on an upper side of the movable spring plate; and, the accommodating chamber is extended upward into the arc isolation portion, and the arc isolation member is fixed to the movable spring plate so that the top of the push rod is located within the accommodating chamber.

Preferably, four positioning notches are formed on the movable spring plate; a first positioning notch and a second positioning notch are formed on the front side of the movable spring plate, and a third positioning notch and a fourth positioning notch are formed on the rear side of the movable spring lead; the first positioning notch and the third positioning notch are located on the left side of the movable spring plate, and the second positioning notch and the fourth positioning notch are located on the right side of the movable spring plate; and, two bosses are formed on the inner side of the front fixed portion and the inner side of the rear fixed portion, respectively, and one boss corresponds to one positioning notch.

Preferably, the insulating plate or the insulating cavity is extended downward to form two arc isolation members, one of which is located on the left side of the push rod while the other one thereof is located on the right side of the push rod.

Preferably, the accommodating chamber runs through the arc isolation members in an up-down direction. With the arrangement, the material consumption of the whole arc isolation members may be reduced. Meanwhile, in the premise of ensuring that the left and right sides of the arc isolation portions have a length L and a height H, the material consumption of the front and rear sides of the arc isolation portions may be reduced, so that side walls of the front and rear sides of the arc isolation portions will not come into contact with the movable spring plate.

Preferably, the arc isolation members are made of insulating plastic material. The arc isolation members may be made of insulating plastic material, so that the arc isolation members are somewhat flexible, and it is convenient for the buckled fixation of the arc isolation members and the movable spring plate.

In the present invention, the occurrence of accidents caused by the contact of opposite arcs may be avoided by isolating the opposite arcs.

DETAILED DESCRIPTION OF THE INVENTION

Embodiment 1

Figure 1:
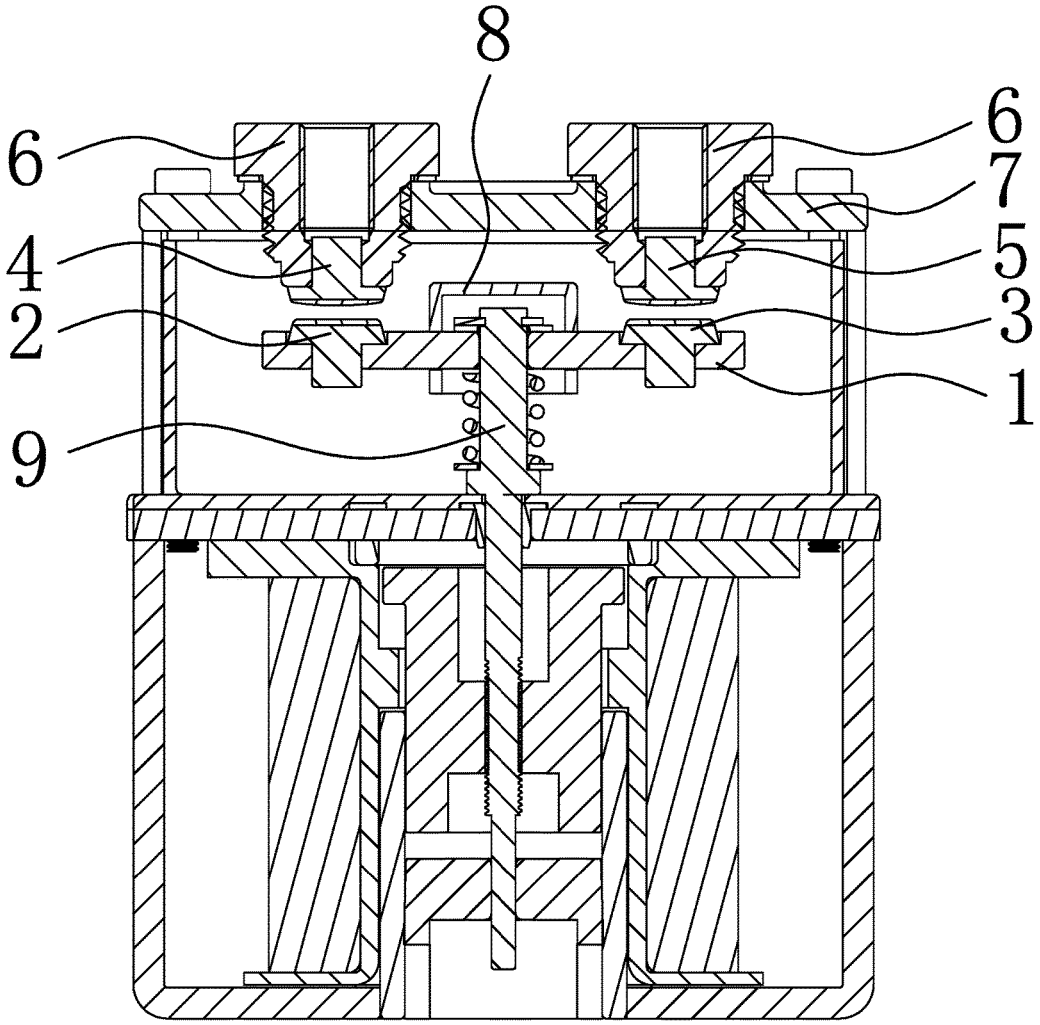
FIG. 1 is a structural diagram of Embodiment 1.
Figure 2:
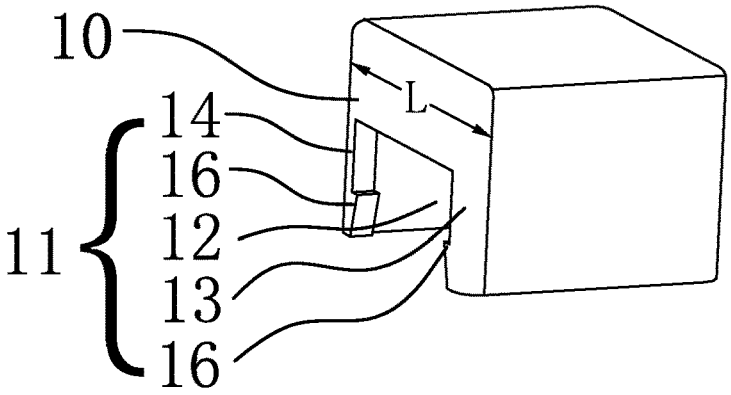
FIG. 2 is a structural diagram of an arc isolation member in Embodiment 1.
Figure 3:
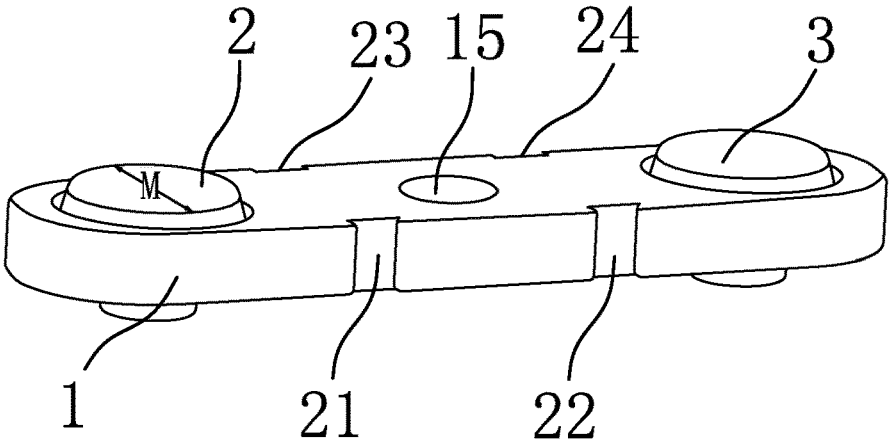
FIG. 3 is a structural diagram of a movable spring plate in Embodiment 1.
Figure 4:
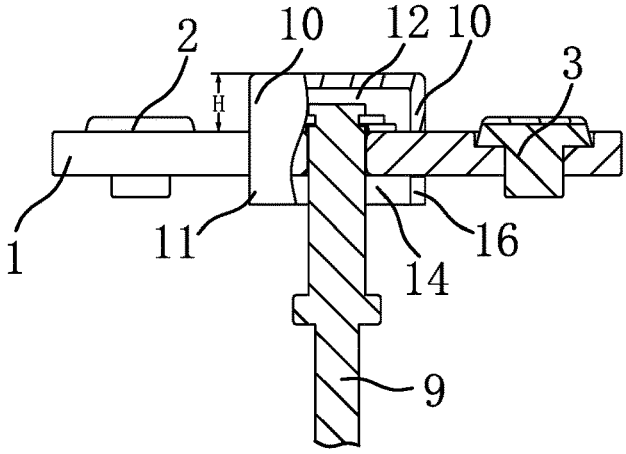
FIG. 4 is a structural diagram of the fixation of the arc isolation member with the movable spring plate in Embodiment 1.

As shown in FIGS. 1, 2, 3 and 4, the opposite arc isolation device of a high voltage direct current relay of the present invention comprises a movable contact assembly and a fixed contact assembly. The movable contact assembly comprises a movable spring plate 1, and a left movable contact 2 and a right movable contact 3 fixed on left and right ends of the movable spring plate 1. The fixed contact assembly comprises a left fixed contact 4 corresponding to the left movable contact 2 and a right fixed contact 5 corresponding to the right movable contact 3. Each of the left fixed contact 4 and the right fixed contact 5 is fixed to a leading-out terminal 6, and the two leading-out terminals 6 are fixed on an insulating plate 7 made of ceramic material.

An arc isolation member 8 is provided between the left fixed contact 4 and the right fixed contact 5. The arc isolation member 8 is made of insulating plastics, and is of a hood-shaped structure. The arc isolation member 8 comprises an arc isolation portion 10 on an upper side and a buckle portion 11 located on a lower side. An accommodating chamber 12 is formed within the buckle portion 11, and the buckle portion 11 and the movable spring plate form buckle structures fitted with each other. The front-to-rear dimension L of the arc isolation portion is greater than the front-to-rear width M of a joint surface of the movable contacts with the fixed contacts. The arc isolation portion has a height H that enables the isolation of opposite arcs between the two sets of movable and fixed contacts. When a push rod 9 drives the movable spring plate 1 to rise so as to realize the joint of the movable contacts with the fixed contacts, an upper edge of the arc isolation portion 10 is located above the joint surface of the movable contacts with the fixed contacts.

Two positioning notches, i.e., a first positioning notch 21 and a second notch 22, are formed on the front side of the movable spring plate 1, and two positioning notches, i.e., a third positioning notch 23 and a fourth positioning notch 24, are formed on the rear side of the movable spring plate 1. The four positioning notches run through the movable spring plate 1 in an up-down direction. The first positioning notch 21 and the third positioning notch 23 are located on the left side of the movable spring plate, and the second positioning notch 22 and the fourth positioning notch 24 are located on the right side of the movable spring plate 1.

The accommodating chamber 12 runs through the buckle portion 11 in an up-down direction, and the accommodating chamber 12 also runs through the buckle portion 11 in a left-right direction, so that the buckle portion 11 has an n-shaped section. A front fixed portion 13 on the front side of the movable spring plate 1 and a rear fixed portion 14 on the rear side of the movable spring plate 1 are formed on the buckle portion 11. Two bosses 16 are formed on lower edges on the inner side of the front fixed portion 13 and the inner side of the rear fixed portion 14, respectively, and one boss corresponds to one positioning notch. A through hole 15 for allowing the push rod to pass therethrough is formed on the movable spring plate 1. The top of the push rod 9 is located on the upper side of the movable spring plate, and the accommodating chamber 12 is extended upward into the arc isolation portion 10.

During the assembly of the arc isolation member 8 and the movable spring plate 1, the four bosses 16 of the arc isolation member are aligned with the four positioning notches, and the arc isolation member 8 is pressed down, so that the arc isolation member 8 is fixed to the movable spring plate 1 in a buckled manner, and the movable spring plate 1 is located within the accommodating chamber 12. The upper edges of the bosses 16 come into contact with the lower edge of the movable spring plate 1, the lower edge of the arc isolation portion 11 comes into contact with the upper edge of the movable spring plate 1, and the top of the push rod is located within the arc isolation portion 10.

Embodiment 2

Figure 5:
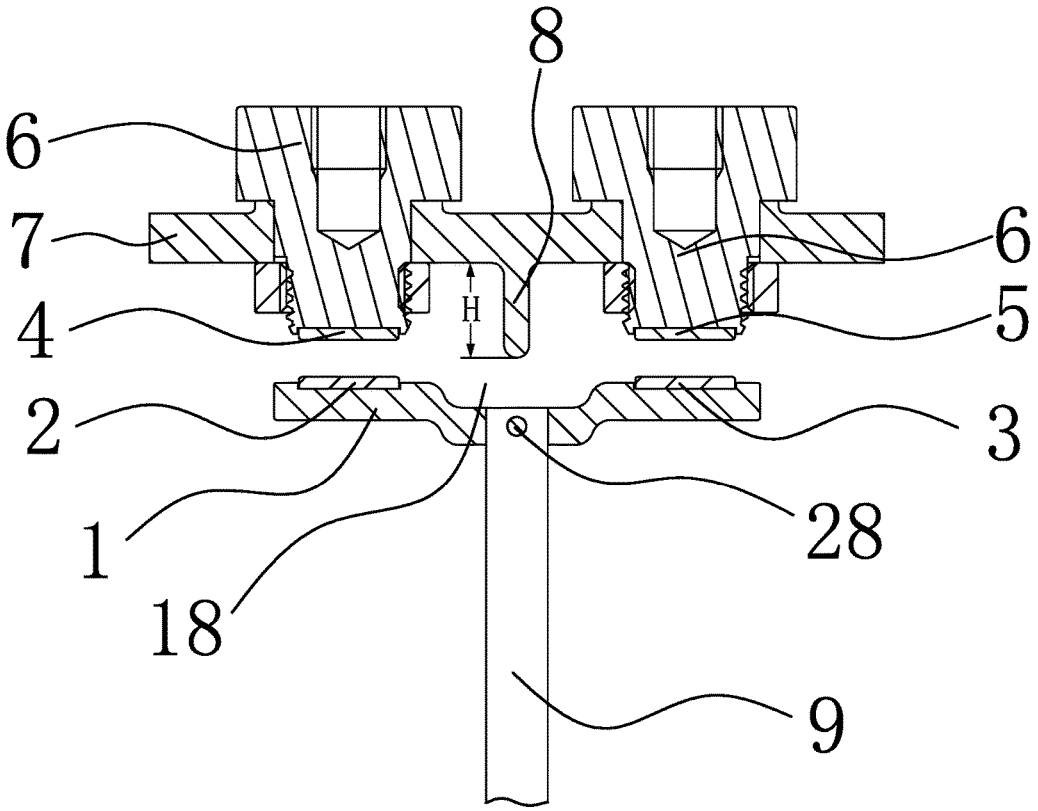
FIG. 5 is a first structural diagram of Embodiment 2.
Figure 6:
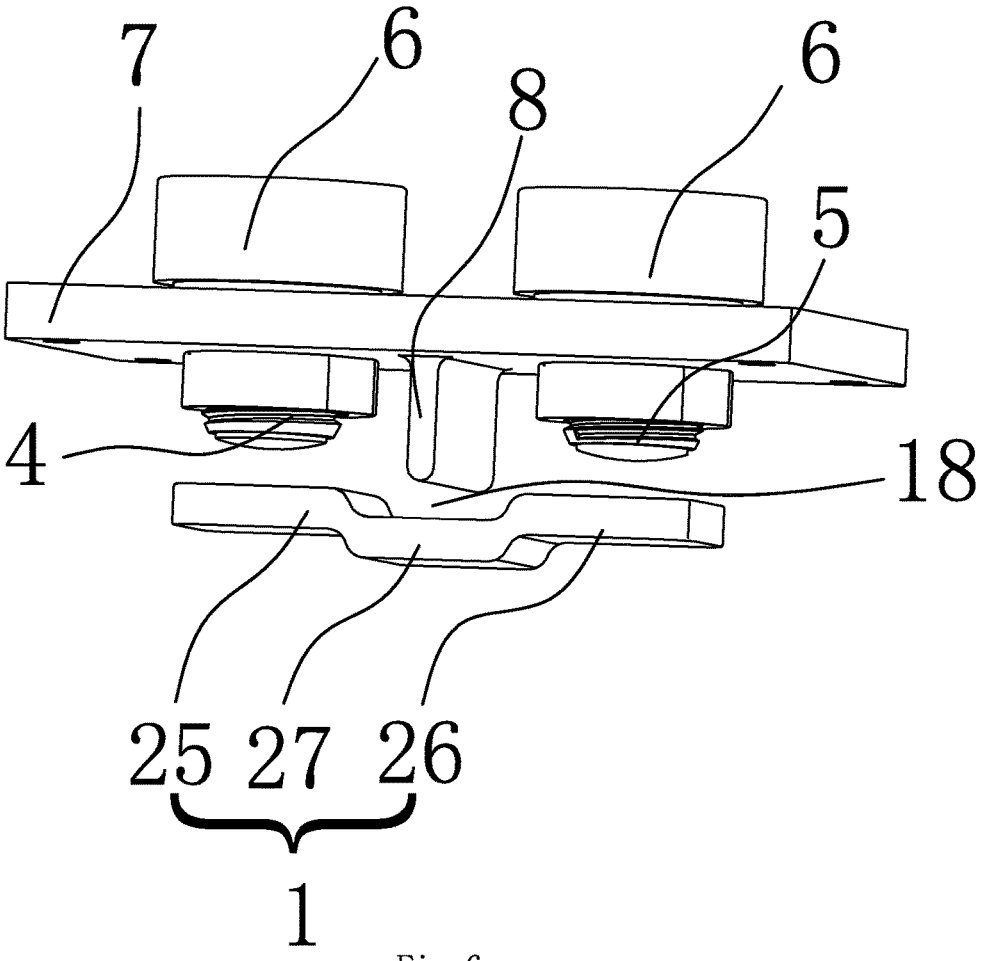
FIG. 6 is a second structural diagram of Embodiment 2.
Figure 7:
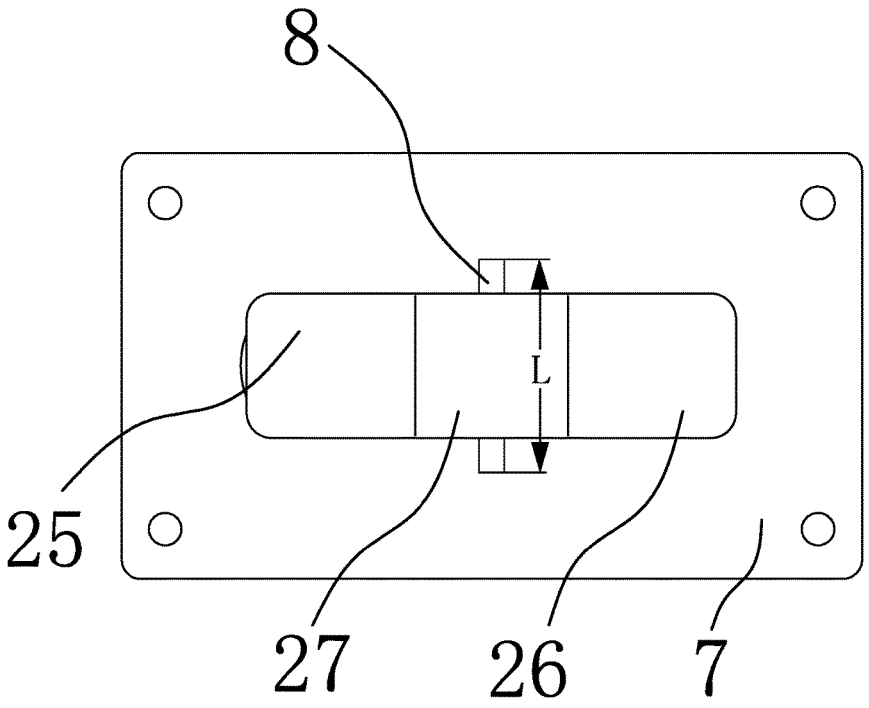
FIG. 7 is a third structural diagram of Embodiment 2.

As shown in FIGS. 5, 6 and 7, the opposite arc isolation device of a high voltage direct current relay of the present invention comprises a movable contact assembly and a fixed contact assembly. The movable contact assembly comprises a movable spring plate 1, and a left movable contact 2 and a right movable contact 3 fixed on left and right ends of the movable spring plate 1. The fixed contact assembly comprises a left fixed contact 4 corresponding to the left movable contact 2 and a right fixed contact 5 corresponding to the right movable contact 3. Each of the left fixed contact 4 and the right fixed contact 5 is fixed to a leading-out terminal 6, and the two leading-out terminals 6 are fixed on an insulating plate 7 made of ceramic material.

The insulating plate 7 is extended downward to form an arc isolation member having a height H that enables the isolation of opposite arcs between the two sets of movable and fixed contacts. The arc isolation member is of a plate-shaped structure, and the front-to-rear dimension L of the arc isolation member is greater than the front-to-rear width M of a joint surface of the movable contacts with the fixed contacts. The arc isolation member and the insulating plate 7 are formed integrally, and the arc isolation member is located between the left fixed contact 4 and the right fixed contact 5. A groove 18 is formed between the left movable contact 2 and the right movable contact 3 of the movable spring plate 1, and the groove 18 runs through the movable spring plate 1 in a front-rear direction. When the push rod 9 drives the movable spring plate 1 to move up to allow the left movable contact 2 to come into contact with the left fixed contact 4 and the right movable contact 3 to come into contact with the right fixed contact 5, the lower end of the arc isolation member is located within the groove 18.

The movable spring plate 1 comprises a first portion 21 fixed to the left movable contact 2, a second portion 26 fixed to the right movable contact 3, and a third portion 27 fixed to the push rod 9. The third portion 27 is located between the first portion 25 and the second portion 26. The height of the first portion 25 is consistent with the height of the second portion 26, and the highest point of the third portion 27 is lower than the highest point of the first portion 25 and the highest point of the second portion 26. That is, the groove 18 is located at a position above the third portion 27. The push rod 9 is fixed to the movable spring plate 1 via a pin 28, and the top of the push rod 9 is not located above the movable spring plate 1.

Embodiment 3

Figure 8:
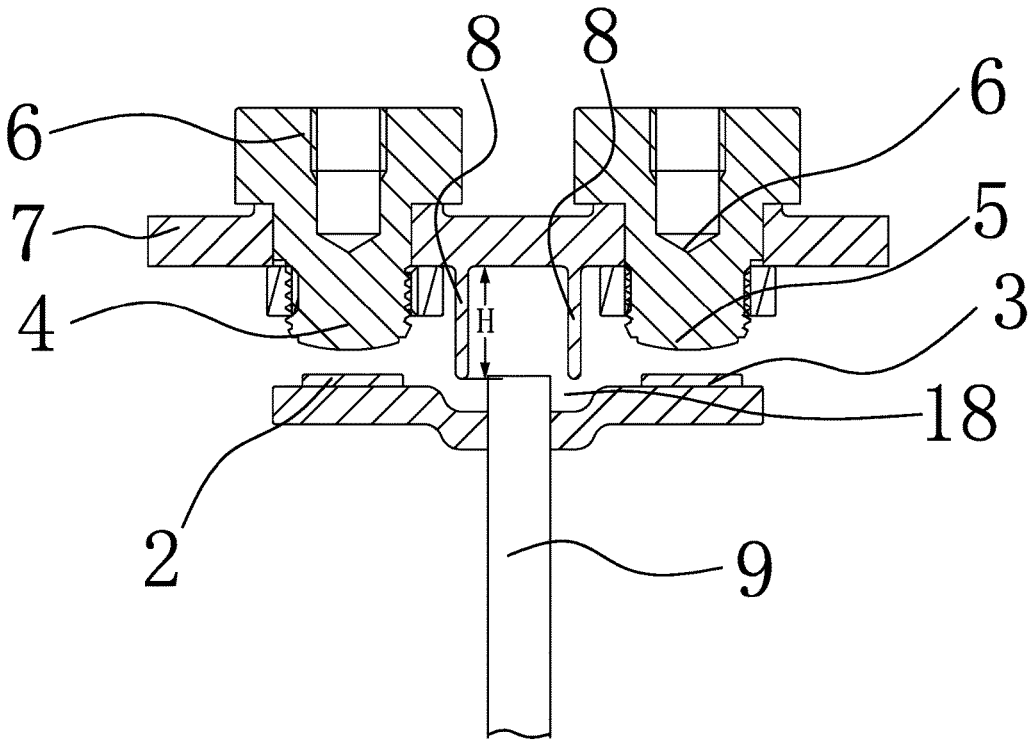
FIG. 8 is a first structural diagram of Embodiment 3.
Figure 9:
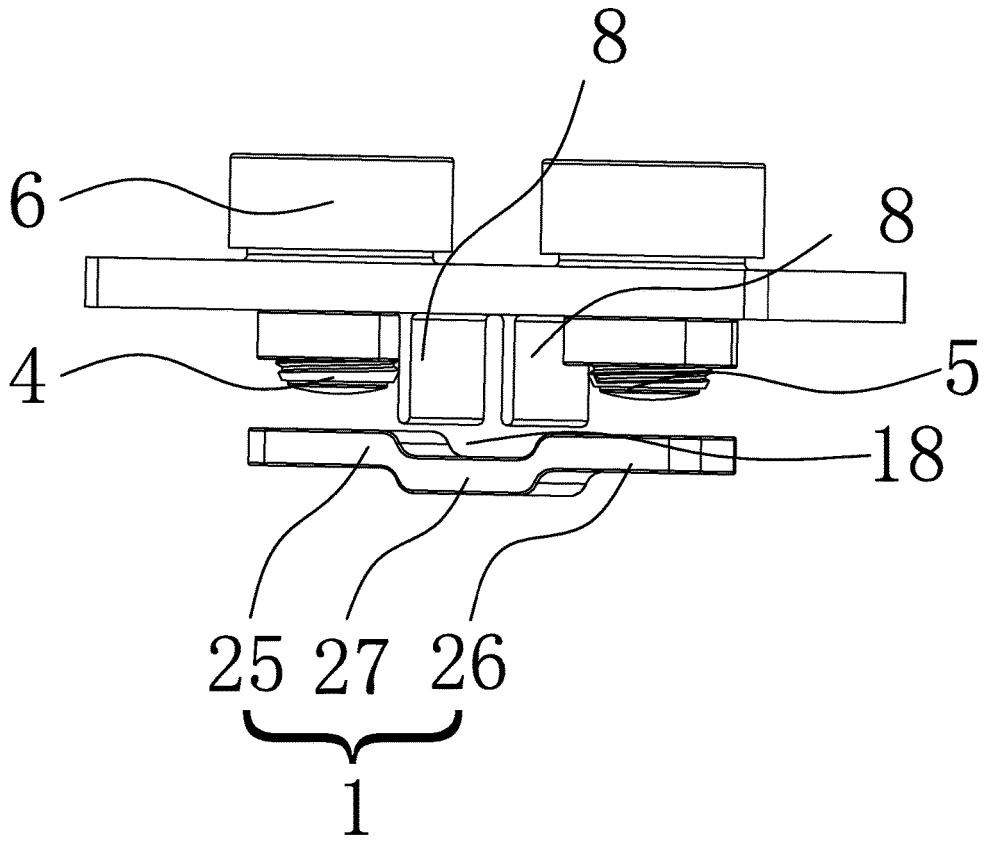
FIG. 9 is a second structural diagram of Embodiment 3.
Figure 10:
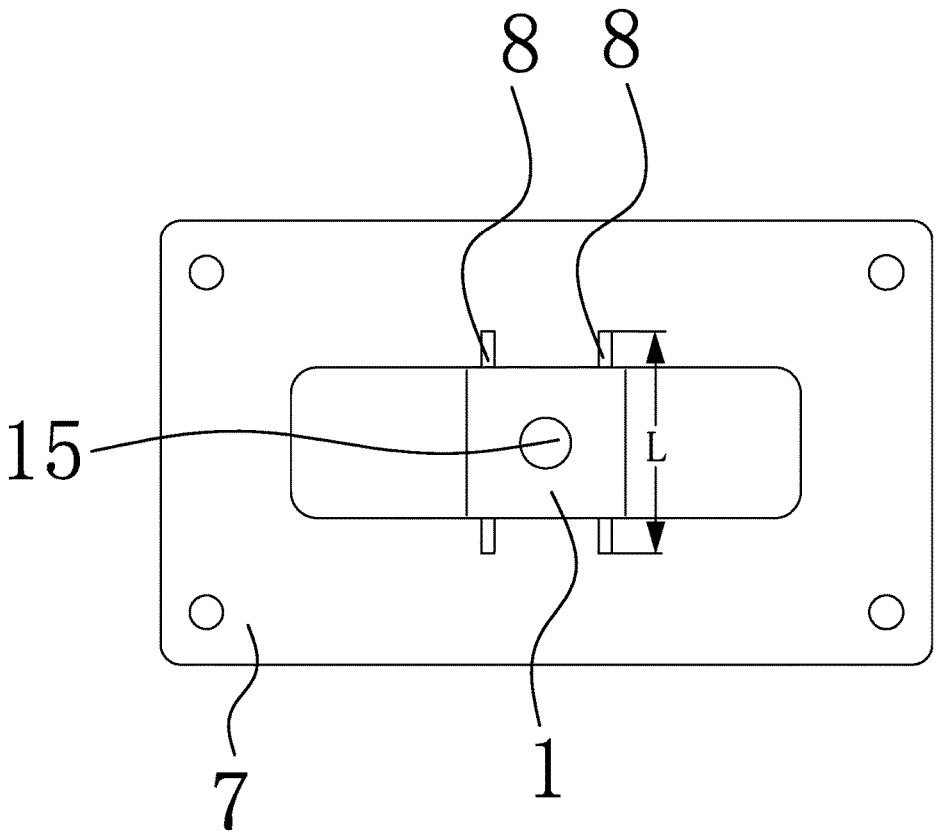
FIG. 10 is a third structural diagram of Embodiment 3.

As shown in FIGS. 8, 9 and 10, the opposite arc isolation device of a high voltage direct current relay of the present invention comprises a movable contact assembly and a fixed contact assembly. The movable contact assembly comprises a movable spring plate 1, and a left movable contact 2 and a right movable contact 3 fixed on left and right ends of the movable spring plate 1. The fixed contact assembly comprises a left fixed contact 4 corresponding to the left movable contact 2 and a right fixed contact 5 corresponding to the right movable contact 3. Each of the left fixed contact 4 and the right fixed contact 5 is fixed to a leading-out terminal 6, and the two leading-out terminals 6 are fixed on an insulating plate 7 made of ceramic material.

The insulating plate 7 is extended downward to form two arc isolation members each having a height H that enables the isolation of opposite arcs between the two sets of movable and fixed contacts. Each of the arc isolation members is of a plate-shaped structure, and the two arc isolation members are arranged in parallel. One of the arc isolation members is located on a left side of a push rod 9, while the other one thereof is located on a right side of the push rod. The front-to-rear dimension L of each of the arc isolation members is greater than the front-to-rear width M of a joint surface of the movable contacts with the fixed contacts. The arc isolation members and the insulating plate 7 are formed integrally, and the two arc isolation members are located between the left fixed contact 4 and the right fixed contact 5. A through hole 15 is formed on the movable spring plate, and the top of the push rod is extended to the upper side of the movable spring plate through the through hole 15.

A groove 18 is formed between the left movable contact 2 and the right movable contact 3 of the movable spring plate 1, and the groove 18 runs through the movable spring plate 1 in a front-rear direction. When the push rod 9 drives the movable spring plate 1 to move up to allow the left movable contact 2 to come into contact with the left fixed contact 4 and the right movable contact 3 to come into contact with the right fixed contact 5, the lower ends of the two arc isolation members are located within the groove 18, and the top of the push rod is located between the two arc isolation members 8.

The movable spring plate 1 comprises a first portion 24 fixed to the left movable contact 2, a second portion 25 fixed to the right movable contact 3, and a third portion 26 fixed to the push rod 9. The third portion 26 is located between the first portion 24 and the second portion 25. The height of the first portion 24 is consistent with the height of the second portion 25, and the highest point of the third portion 26 is lower than the highest point of the first portion 24 and the highest point of the second portion 25. That is, the groove 18 is located at a position above the third portion 26.

The present invention is applied to high voltage direct current relays. In the present invention, the occurrence of accidents caused by the contact of opposite arcs may be avoided by isolating the opposite arcs.

The invention claimed is:

1. An opposite arc isolation device of a high voltage direct current relay, comprising a movable contact assembly and a fixed contact assembly, wherein the movable contact assembly comprises a movable spring plate and a left movable contact and a right movable contact fixed at left and right ends of the movable spring plate; the fixed contact assembly comprises a left fixed contact corresponding to the left movable contact and a right fixed contact corresponding to the right movable contact an arc isolation member made of an insulating material is provided between the left movable contact and the right fixed contact a front-to-rear dimension L of the arc isolation member is greater than a front-to-rear width M of a joint surface of the movable contacts with the fixed contacts; and, the arc isolation member has a height H that enables the isolation of opposite arcs between the two sets of movable and fixed contacts, wherein the arc isolation member is fixed on the movable spring plate; positioning notches are formed on a front side and a rear side of the movable spring plate; an accommodating groove running downward through the arc isolation member is formed at a lower end of the arc isolation member, and the accommodating groove transversely runs through the arc isolation member; a buckle structure is formed on the arc isolation member; and, the buckle structure is fitted with the positioning notches to position the movable spring plate within the accommodating groove.

2. The opposite arc isolation device of the high voltage direct current relay according to claim 1, wherein the arc isolation member is of a hood-shaped structure; the arc isolation member comprises an arc isolation portion on an upper side and a buckle portion on a lower side; an accommodating chamber is formed within the buckle portion, and the buckle portion has an n-shaped section; the accommodating chamber runs through the buckle portion in an up-down direction, and the accommodating chamber transversely runs through the buckle portion, so that a front fixed portion on the front side of the movable spring plate and a rear fixed portion on the rear side of the movable spring plate are formed on the buckle portion; bosses are formed on lower edges on an inner side of the front fixed portion and an inner side of the rear fixed portion; the positioning notched longitudinally runs through the movable spring plate, and the arc isolation member is fixed to the movable spring plate so that upper edges of the bosses come into contact with a lower edge of the movable spring plate and a lower edge of the arc isolation portion comes into contact with an upper edge of the movable spring plate.

3. The opposite arc isolation device of the high voltage direct current relay according to claim 2, wherein a through hole for allowing a push rod to pass therethrough is formed on the movable spring plate; a top of the push rod is located on an upper side of the movable spring plate; and, the accommodating chamber is extended upward into the arc isolation portion, and the arc isolation member is fixed to the movable spring plate so that the top of the push rod is located within the accommodating chamber.

4. The opposite arc isolation device of the high voltage direct current relay according to claim 3, wherein four positioning notches are formed on the movable spring plate; a first positioning notch and a second positioning notch are formed on the front side of the movable spring plate, and a third positioning notch and a fourth positioning notch are formed on the rear side of the movable spring lead; the first positioning notch and the third positioning notch are located on the left side of the movable spring plate, and the second positioning notch and the fourth positioning notch are located on the right side of the movable spring plate; and, two bosses are formed on the inner side of the front fixed portion and the inner side of the rear fixed portion, respectively, and one boss corresponds to one positioning notch.

5. The opposite arc isolation device of the high voltage direct current relay according to claim 2, wherein the accommodating chamber runs through the arc isolation members in an up-down direction.

6. The opposite arc isolation device of the high voltage direct current relay according to claim 2, wherein the arc isolation members are made of insulating plastic material.

* * * * *